United States Patent [19]

Nakamura et al.

[11] Patent Number: 4,796,053

[45] Date of Patent: Jan. 3, 1989

[54] MAGNIFICATION CONVERTING MECHANISM FOR A VARIABLE MAGNIFICATION COPYING APPARATUS

[75] Inventors: Hiroshi Nakamura, Yamatokoriyama; Tatsushi Hayashi; Ken-ichi Iwamoto, both of Nara; Kenji Okada, Yamatokoriyama; Kouichi Matsumoto, Gojo; Shoichiro Yoshiura, Yamatokoriyama, all of Japan

[73] Assignee: Sharp Kabushiki Kaisha, Osaka, Japan

[21] Appl. No.: 104,047

[22] Filed: Oct. 2, 1987

[30] Foreign Application Priority Data

Oct. 4, 1986 [JP] Japan ..... 61-236898
Oct. 4, 1986 [JP] Japan ..... 61-236899

[51] Int. Cl.[4] ..... G03G 15/00

[52] U.S. Cl. ..... 355/8; 355/14 R; 355/55

[58] Field of Search ..... 355/8, 3 R, 14 R, 55, 355/56

[56] References Cited

U.S. PATENT DOCUMENTS

| | | | |
|---|---|---|---|
| 4,533,233 | 8/1985 | Kimura et al. | 355/8 |
| 4,669,858 | 6/1987 | Ito et al. | 355/8 |
| 4,710,018 | 12/1987 | Miyaji | 355/8 |
| 4,714,941 | 12/1987 | Yamagishi et al. | 355/8 |

*Primary Examiner*—A. C. Prescott
*Attorney, Agent, or Firm*—Birch, Stewart, Kolasch & Birch

[57] ABSTRACT

A variable magnification apparatus is provided with a magnification converting mechanism and a scan speed change mechanism. In the magnification converting mechanism, the force generated by operating a magnification converting lever is transmitted to the lens holder through a magnification change-over arm and to a speed change selection member through a scan speed change shaft. In the scan speed change mechanism, the number of rotations of an output shaft is changed by a selected rotation transmission member which is actuated by a speed change ratio selection member.

10 Claims, 14 Drawing Sheets

MAGNIFICATION CONVERTING MECHANISM FOR A VARIABLE MAGNIFICATION COPYING APPARATUS

BACKGROUND OF THE INVENTION

1. Field of the Invention

The present invention relates to a variable magnification copying apparatus, and more particularly, to an improved magnification converting mechanism for a variable magnification copying apparatus capable of effecting selected magnification, through manual alteration of lens positions with changing an original document scap speed of an optical system and to an improved scan speed changing mechanism for a variable magnification copying apparatus capable of changing an original document scan speed of an optical system.

2. Description of the Prior Art

Generally, when the image of an original document is magnified or reduced so as to copy the image on a sheet of paper, it is necessary to change not only a lens position but also the scan speed of an optical system to be applied thereto in response to the values of magnifications. Accordingly, in conventional variable magnification copying apparatuses, there are provided one drive means for changing a lens position and another drive means for scanning the image of the original document by the optical system, i.e., two kinds of drive means are necessary to carry out the above-described operations. In such an apparatus, one drive means is operated to change the position of a lens according to a selected magnification and the other drive means is controlled to change the scan speed of the image of the original document. A DC motor is generally used as the drive means for scanning the image of the original document, so that the number of rotations of the DC motor is controlled to change the image scan speed. Also, a variable magnification copying apparatus disclosed in Japanese Patent Laid-open Publication (unexamined) No. 165633/1985, is provided with a plurality of planet gears which rotate in unison with the rotation of an input shaft. The torque of the input shaft is selectively transmitted to a planet carrier which supports the axes of the planet gears through a spring clutch. The number of rotations of the output shaft is changed by selectively operating the planet gears which transmit the torque of the input shaft to the output shaft. When the planet gears which engage with gears mounted on the output shaft are selectively operated, the torque is transmitted to the planet carrier of the planet gears through the spring clutch. The operation of the spring clutch is controlled by changing the position in which a control pawl, provided with an arm operatively connected to a lever manually operated, contacts with a pawl provided with the spring clutch. With this construction, this apparatus is designed to make the construction of the speed change gears simpler with a manual selection of the scan speed, and to reduce the manufacturing cost.

However, the above-described variable magnification copying apparatus has disadvantages such as to render the construction in a large size at an expensive cost because a DC motor is used, which leads to the use of many motors including a lens drive motor. Although this construction can eliminate the need for installing a motor to scan the image of the original document by changing a scan speed manually, however, it is necessary to provide a motor which changes the lens position, and further, the lens position changing operation and the image scan speed changing operation are required to be made independently. Therefore, the apparatus is not compact and its cost is not so inexpensive. Moreover, the operation to change a magnification is complicated.

In addition to the above-described disadvantages, each time the image scan speed is changed, the planet gears and the spring clutch rotate, with the result that the pawl provided with the spring clutch contacts with the control pawl provided with the arm to generate a big noise. Furthermore, the torque to rotate the spring clutch, planet gears, and the planet carrier of the planet gears about the input shaft is great, which leads to the provision of a large main motor.

SUMMARY OF THE INVENTION

It is therefore an object of the present invention to provide a magnification converting mechanism for a variable magnification copying apparatus in which the operation for changing a lens position and image scan speed can be accomplished by a single operation, and neither a means for changing a lens position nor a means for carrying out an image scan is provided so that an inexpensive and compact copying machine is manufactured and the operation for converting a magnification is facilitated.

It is another object of the present invention to provide a magnification converting mechanism for a variable magnification copying apparatus in which the rotation speed of an output shaft is changed by selectively connecting gears mounted on an input shaft to gears mounted on an output shaft so as to make the apparatus compact and manually change an image scan speed and prevent a big noise from being generated in changing the image scan speed, and manufacture the apparatus at a low cost by using a motor whose torque is small.

In accomplishing these and other objects, according to one aspect of the present invention, there is provided a magnification converting mechanism of a variable magnification copying apparatus which comprises a magnification converting lever provided on a control panel; a magnification change-over arm and an image scan speed changing shaft interlocked with the magnification converting lever; a lens holder which slidably engages with a sliding shaft and hooks part of the magnification change-over arm and slides on the sliding shaft with the movement of the magnification change-over arm; a lens assembly held by the lens holder; an image scan speed change unit by which the image scan speed of an optical system is altered by changing speed change ratios; and a speed change ratio selection means interlocked with the image scan speed change shaft so as to make operative one of a plurality of speed change ratios provided with the image scan speed change system.

Accordingly, in the magnification converting mechanism for a variable magnification copying apparatus according to the present invention, the magnification change-over arm and the image scan speed change shaft are interlocked with the operation of the magnification converting lever. The force generated by the operation of the magnification change-over arm is transmitted to the lens holder which slides along the sliding shaft. The torque generated by the rotation of the image scan speed change shaft is transmitted to the speed change ratio member, whereby the speed change ratio of the image scan speed change system is changed, i.e., the force generated by operating the magnification converting lever is transmitted to the lens holder through the magnification change-over arm and to the speed change selection member through the image scan speed change shaft as well.

In another aspect of the present invention, there is provided an image scan speed change mechanism for a variable magnification copying apparatus which changes the image scan speed of the optical system comprises gears fixed to an input shaft; a predetermined number of input shaft change gears which engage with the gears fixed to the input shaft; gears fixed to an output shaft; the predetermined number of output shaft change gears which engage with the gears fixed to the output shaft and disposed at the shaft on which the input shaft change gears are mounted and have different number of teeth; the predetermined number of rotation transmission members which transmit the torque of the input shaft change gears to the output shaft change gears which confront the input shaft change gears; and a speed change ratio selection member which makes one of the rotation transmission members operative.

Accordingly, in the image scan speed converting mechanism for a variable magnification copying apparatus according to the present invention, the rotation of the input shaft to which torque has been transmitted from the drive unit is transmitted to a predetermined number of the input shaft change gears through gears fixed to the input shaft, whereby all of the input shaft change gears rotate. Gears are fixed to the output shaft and a predetermined number of output shaft change gears engage with the gears fixed to the output shaft. The output shaft change gears are mounted on the shaft where the input shaft change gears are mounted and the torque of the input shaft change gears is transmitted to the output shaft change gears through the rotation transmission members. A rotation transmission member is provided for an input shaft change gear and an output shaft change gear, whereby one of a predetermined number of rotation transmission members is made selectively operative by the speed change ratio selection member. The number of teeth of the predetermined number of output shaft change gears is different. Therefore, the torque to be transmitted to the output shaft varies on which of the rotation members is made operative, i.e., the number of rotations of the output shaft is changed by a selected rotation transmission member which is actuated by the speed change ratio selection member.

BRIEF DESCRIPTION OF THE DRAWINGS

These and other objects and features of the present invention will become apparent from the following description taken in conjunction with the preferred embodiment thereof with reference to the accompanying drawings, and in which.

DESCRIPTION OF THE PREFERRED EMBODIMENTS

Figure 1:
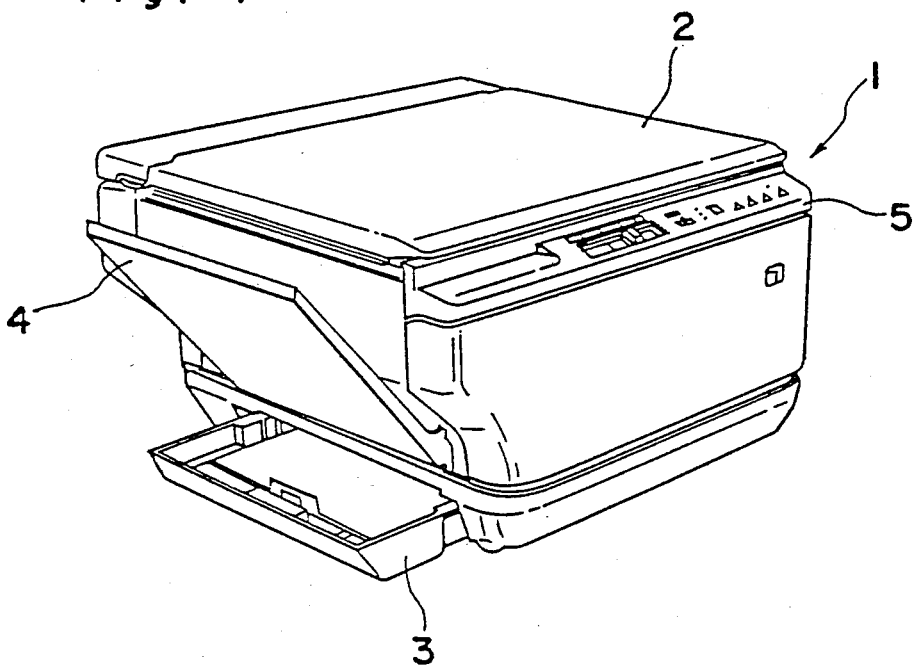
FIG. 1 is a perspective view showing an external appearance of an electrophotographic copying machine in accordacne with one preferred embodiment of the present invention.

Before the description of the present invention proceeds, it is to be noted that like parts are designated by like reference numerals throughout the accompanying drawings.

The drawings show a variable magnification copying apparatus provided with a magnification converting mechanism according to a preferred embodiment of the present invention.

The embodiment of the present invention is described in the following order.

1. External appearance (refer to FIG. 1)
2. Entire construction (refer to FIG. 2)
3. Control panel (refer to FIG. 3)
4. Lens unit (refer to FIGS. 4 and 5)
5. Blank lamp unit (refer to FIG. 6)
6. Optical system cleaning construction (refer to FIGS. 7 through 9)
7. Exhaust construction (refer to FIGS. 10 and 11)
8. Lens position warning display (refer to FIG. 12)
9. Scan speed change mechanism (refer to FIGS. 13 through 16)

1. External appearance of a variable magnification copying machine

FIG. 1 is an external view showing an electrophotographic copying machine according to the embodiment of the present invention. An original document cover 2 is pivotally supported at its rear end on the top surface of a copying machine 1 so as to be raised or lowered for opening or closing. A paper supplying cassette 3 is mounted on the copying machine 1 at the bottom thereof. The paper supplying cassette 3 can be selectively attached to the copying machine 1 depending on the size of paper to be housed therein. A paper discharge tray 4 is mounted at the left side of the copying machine 1. A sheet of paper supplied from the paper supplying cassette 3 passes through the copying unit in the copying machine 1, and thereafter, is transported to the paper discharge tray 4 after it passes through the paper discharge unit not shown in the drawing. A control panel 5 is installed on the front of the top surface of the copying machine 1. A print switch, magnification setting lever, and the like are mounted on the control panel 5. The detailed description of the control panel 5 is given later.

2. Entire construction

Figure 2:
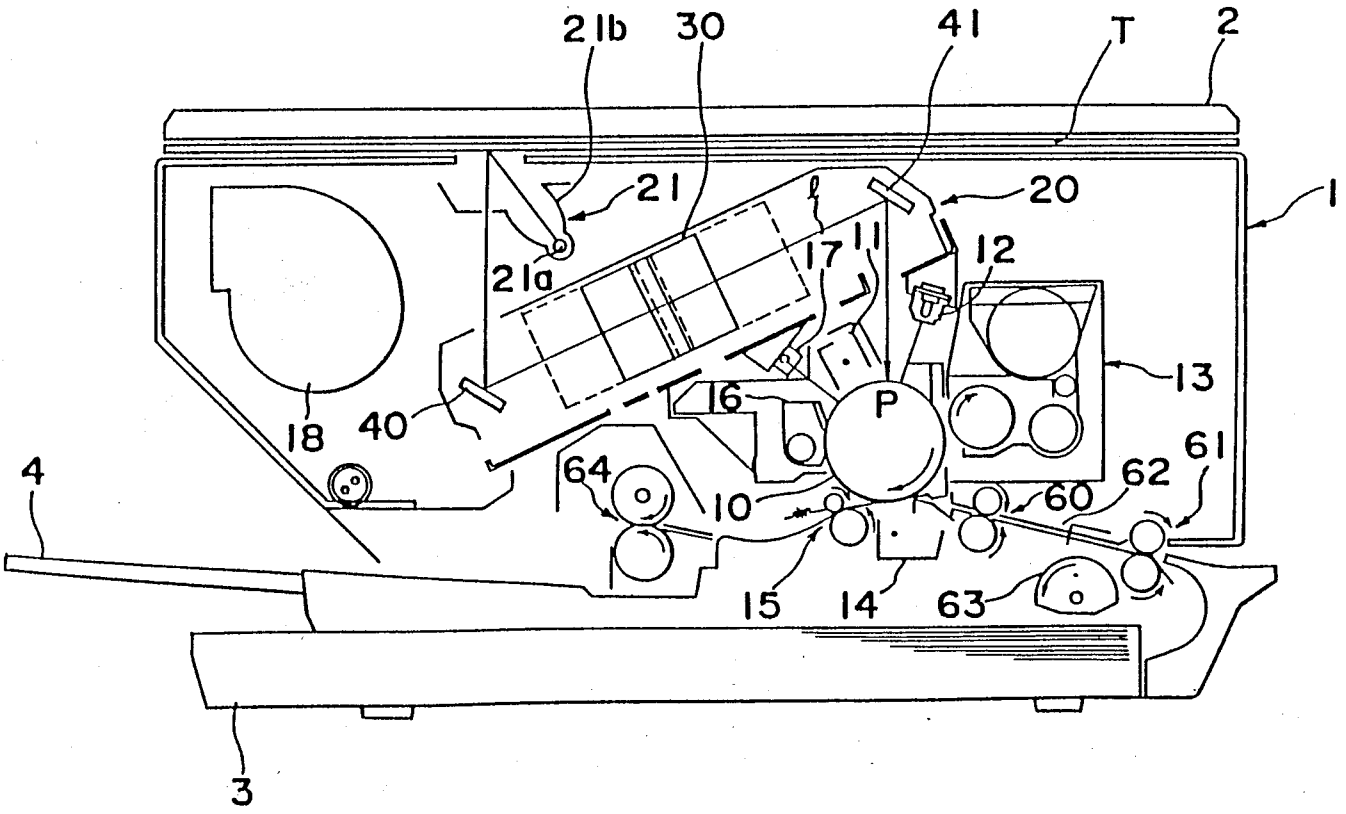
FIG. 2 is a schematic side sectional view showing general construction of the copying machine of FIG. 1.

FIG. 2 is a view showing the entire construction of the copying machine.

The copying machine generally includes a photosensitive or photoreceptor drum 10 having a photosensitive surface on its peripheral surface and rotatably mounted at approximately the central portion of the copying machine 1 so as to be driven for rotation in the direction indicated by an arrow, and various processing stations such as a main corona charger 11, a blank lamp unit 12, a developing unit 13, an image transfer charger 14, a set of paper separating rollers 15, a cleaner unit 16, and a deelectrifying or charge erasing lamp 17 which are sequentially disposed around the photosensitive surface of said photoreceptor drum 10 as illustrated. A symbol P shown at an upper portion of the photosensitive drum 10 indicates the exposure point on which a light transmitted from the optical system is incident.

An optical system provided at an upper portion of the copying machine 1 comprises a lens unit 20 and a light source unit 21. The lens unit 20 is movable along the optical axis. The lens unit 20 includes a lens 30 and two reflecting mirrors 40, 41. The lens 30 is movable along as well as perpendicular (direction perpendicular to the drawing) to the optical axis l. The lens unit 20 is composed of a side plate, a lens unit cover which covers the upper portion of the side plate, and a lens unit base positioned at the bottom of the side plate. The lens unit cover is capable of sliding so as to be opened and closed. The detailed description of the lens unit cover is made later. An air flow opening (air suction opening) is provided at the lens unit base.

The light source unit 21 includes a light source 21*a* and a reflector 21*b*. Since an original document platform T disposed at the upper portion of the copying machine 1 of the embodiment is movable, the light source unit 21 and the lens unit 20 are fixed to the copying machine 1.

A unit composed by integrating the photosensitive drum 10, main charger 11, and cleaner unit 16 is detachable from the copying machine 1. The developing unit 13 is also detachable therefrom. Therefore, the above-described two units are replaced as necessary.

Two sets of a paper transport rollers 60, 61 and a paper transport passage 62 are mounted at the lower right portion of the photosensitive drum 10. A semicircular paper supplying roller 63 is mounted thereunder. Through rotation of the paper supplying roller 63, a sheet of paper disposed uppermost on sheets of paper housed in the paper supplying cassette 3 is supplied to the copying machine 1, and thereafter, transported to the copying unit through the paper transport rollers 61, 60, and the paper transport passage 62. Fixing rollers 64 are mounted at the left side of the photosensitive drum 10. A toner image is transferred onto a sheet of paper by the copying unit. The transferred toner image is fixed to the paper by the fixing rollers 64. Thereafter, the paper is transported to the paper discharge tray 4. The fixing rollers 64 according to this embodiment serve as paper discharge rollers. Numeral 10 denotes an exhaust fan.

According to the above-described construction, when an original document is placed on the original document platform T and a print switch is operated, the original document platform T reciprocates and the light source unit 21 is actuated, whereby the image of the original document is scanned by the light source unit 21. A light which has been reflected from the original document passes through the lens unit 20, and thereafter, is incident upon the exposure point P, of the photosensitive drum 10, at which an electrostatic latent image is formed. The electrostatic latent image which has been formed on the surface of the photosensitive drum 10 by the developing unit 13 is developed into a visible image by the developing unit 13. The image which has been thus developed is transferred onto a sheet of paper transported from the paper supplying cassette 3 by the image transfer charger 14. Thereafter, the image on the paper is fixed by the fixing rollers 64, and then, the paper is discharged into the paper discharge tray 4. Toner particles which have remained on the photosensitive drum 10 are removed therefrom by the cleaner unit 16. Residual electric charge on the photosensitive drum 10 is erased by the charge erasing lamp 17, whereby the following copying operations are carried out.

3. Control panel

Figure 3:
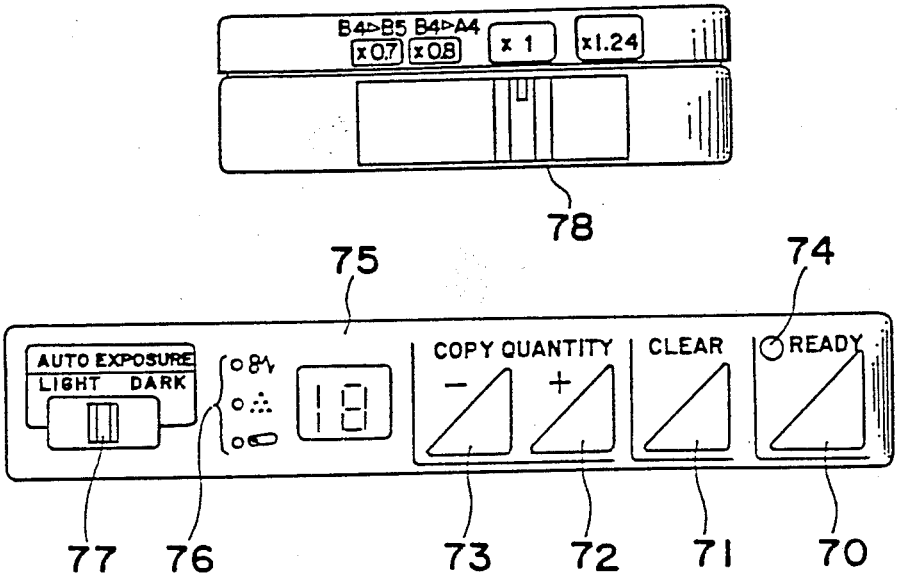
FIG. 3 is a top plan view showing an arrangement on a control panel of the copying machine of FIG. 1.

FIG. 3 shows the construction of the control panel. Numeral 70 denotes the print switch (print key). Numeral 71 denotes a clear key to clear the number set previously. Numerals 72 and 73 denote keys to set the number of copying sheets. Numeral 74 denotes a ready lamp to indicate that the copying machine 1 is ready to carry out a copying. Numeral 75 denotes an indicator. Numeral 76 denotes a warning display lamp. Numeral 77 denotes a switch (key) to set an exposure mode. Numeral 78 denotes a magnification converting lever.

The warning display lamp 76 indicates a paper jamming and toner shortage. The exposure mode setting switch 77 sets an exposure mode to standard, dark, light in carrying out an automatic exposure. The magnification converting lever 78 selects a magnification from among the four magnifications.

4. Lens unit

The magnification converting mechanism which is one of the characteristic features of the present invention is described hereinafter.

Figure 4:
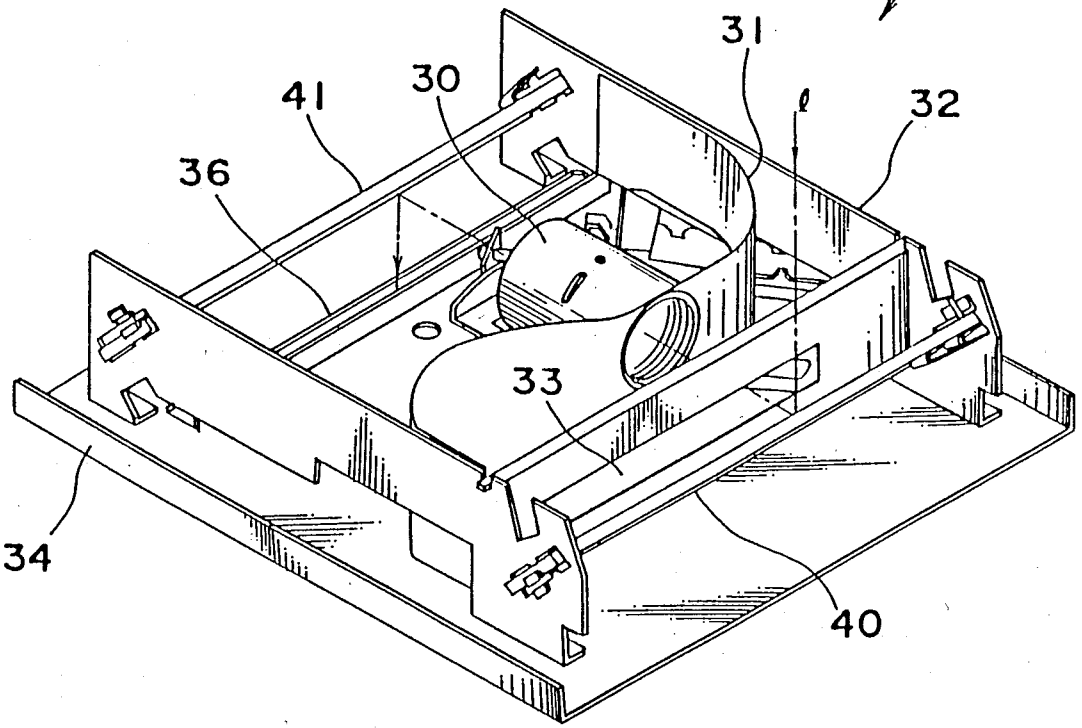
FIG. 4 is a perspective view showing construction of a lens unit employed in the copying machine of FIG. 1, FIGS. 5(A) and 5(B) are top plan views of a lens unit displacing mechanism for explaining the state of functioning thereof.

FIG. 4 is a perspective view of an external appearance of the lens unit 20.

The lens unit displacement mechanism whose detail is described later permits the lens assembly 30 to move to a predetermined position in the lens unit 20. A flexible light shielding sheet 31 is provided to extend to opposite sides of the lens assembly 30 inside the lens unit main body 32. The sheet 31 serves as a means for shielding lights (stray light) which do not pass through the lens assembly 30. Both ends of the sheet 31 are in contact with the internal walls of the lens unit 32. The configuration of the sheet 31 is an inverted letter "S". A first slit 33 is provided between the lens 30 and a first reflection mirror 40. A second slit 36 is provided at a portion which confronts a second reflection mirror 41 mounted on a lens unit base 34.

A light which has been reflected from an original document is reflected by the first mirror 40, and thereafter, is incident upon the lens 30 after the light passes through the first slit 33. The light which has passed through the lens assembly 30 is reflected downwards by the first mirror 40, and then, incident upon the exposure point P shown in FIG. 1 after it passes through the second slit 36 provided on the lens unit base 34.

Lens unit displacement mechanism

The lens unit displacement mechanism is mounted on the lens unit base 34 shown in FIG. 4. This mechanism controls the position of the lens assembly 30 in unison with the operation of a magnification converting lever 76 as shown in FIG. 3.

Figure 5A:
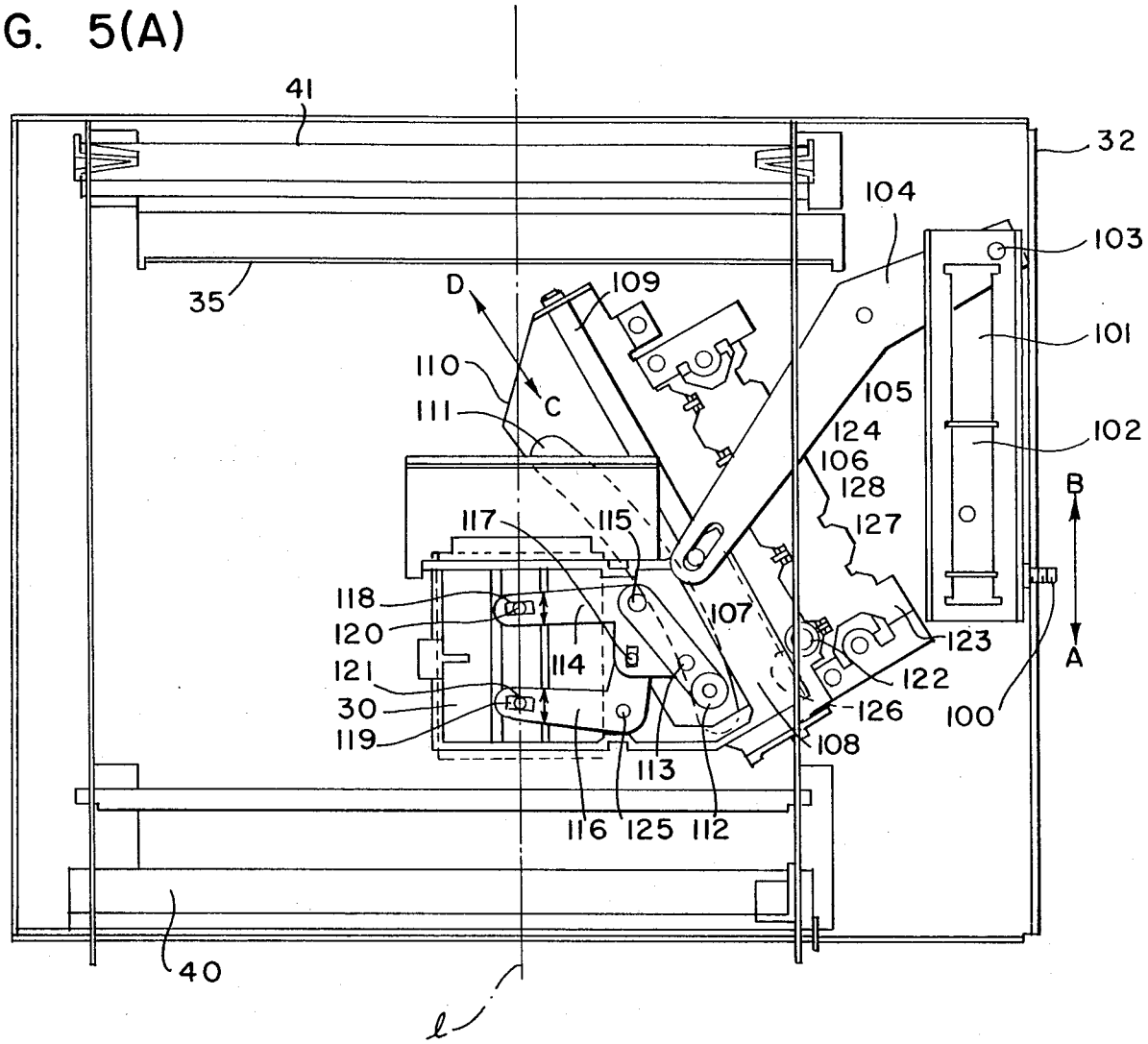

FIG. 5(A) is a view showing the lens unit displacement mechanism.

A lens unit moving lever 100 (hereinafter referred to as a moving lever 100) is linked to the magnification converting lever 78 through the link mechanism not illustrated in the drawing, i.e., both levers are linked to each other by connecting one lever to one end of the link mechanism and the other to the other end thereof so that both levers may move in the same direction. The moving lever 100 is capable of moving in the directions A and B as shown by the arrow. The moving lever 100 is fixed to a sliding lever 101 mounted on the side plate of the lens unit main body 32. The sliding lever 101 is supported by a sliding lever supporting member 102 to be slidable in the directions A and B shown by the arrow. One end of a magnification change-over arm 104 generally in an inverted V-shape is pivotally supported at the upper portion of the sliding lever 101 by a pin 103. The magnification change-over arm 104 is supported by a pin 105 at approximately the intermediate portion thereof so as to be rotatable about the pin 105. An elongated opening 106 is formed on one end of the magnification change-over arm 104. A pin 107 is fitted in the elongated opening 106. The pin 107 is mounted on a lens holder 108 which holds the lens assembly 30 such that the pin 107 projects upwards from and perpendicular to the drawing. The lens holder 108 is slidable along a sliding shaft 109. Both ends of the sliding shaft 109 are fixed to a support plate 110. The support plate 110 is fixed to the lens unit base 34 with a certain angle formed relative to the base 34. A slightly curved elongated guide groove 111 is mounted on the left side of the supporting plate 111. A roller-shaped member 112 is fitted in the guide groove 111 so as to be guided thereby. The member 112 is mounted on one end of an arm 113. An inverted L-shaped first lens displacement member 114 is rotatably connected to one end of an arm 113 by a pin 115. A second lens displacement member 116 in the shape of an inverted L is connected to the first lens displacement member 114 by a pin 117 in symmetrical relationship with the first lens moving member 114. Elongated openings 118 and 119 are formed at the ends of the first and second lens displacement members 114 and 116, respectively. Pins 120 and 121 are projected perpendicular to and upwards from the lens assembly 30 (drawing) are fitted in the elongated openings 118 and 119.

The lens assembly 30 comprises a compound lens and a casing. The pins 120 and 121 are movable in the directions A and B shown by the arrow. The pins 120 and 121 are fixed to a predetermined lens unit of the compound lens mounted in the casing, respectively. With the movements of the pins 120 and 121, the lens unit to which the pins are fixed move, whereby the focal length of the lens assembly 30 is changed, i.e., the magnification thereof can be converted. The lenses of such a construction are widely used in variable magnification copying machines. Therefore, its description of omitted herein.

A lens displacement restricting pin 122 is mounted, through a leaf spring 126, at a position opposite to the lens assembly 30 held by the lens holder 108. A lens displacement restricting plate 123 is mounted at the right of and parallel to the sliding shaft 109. Four recesses 127 are formed on the lens position restricting plate 123 at the left side thereof. Detection switches 124 are disposed in the respective recesses 127. Four similar recesses 128 are also formed in the lens position restricting plate 123 at the right side thereof. The detailed description of the lens position restricting plate 123 is given later. The four recesses provided at the right side are used for paper sheets in inch system, which will be described later.

When the lens displacement restricting pin 122 fitted in the recess 127 depresses the detection switch 124, the switch is turned on, and the ON signal is inputted to a microcomputer mounted on the control unit, whereby it is detected that the lens holder 108 is at a predetermined position. The four recesses 127 determine the lens assembly 30 position which corresponds to a magnification set by the magnification converting lever 78. Specifically the lowermost restricting plate 123 corresponds to the magnification of $\times 1.24$. The recess directly above the lowermost one corresponds to the magnification of $\times 1$ (life size or equal size magnification). The recess positioned above the second lowermost recess corresponds to the magnification of $\times 0.8$. The uppermost recess corresponds to the magnification of $\times 0.7$. The lens holder 108 slides along the sliding shaft 109, with the result that the lens displacement restricting pin 122 fixed to the lens holder 108 engages with one of the recesses, whereby the position of the lens assembly 30 is determined.

Figure 5B:
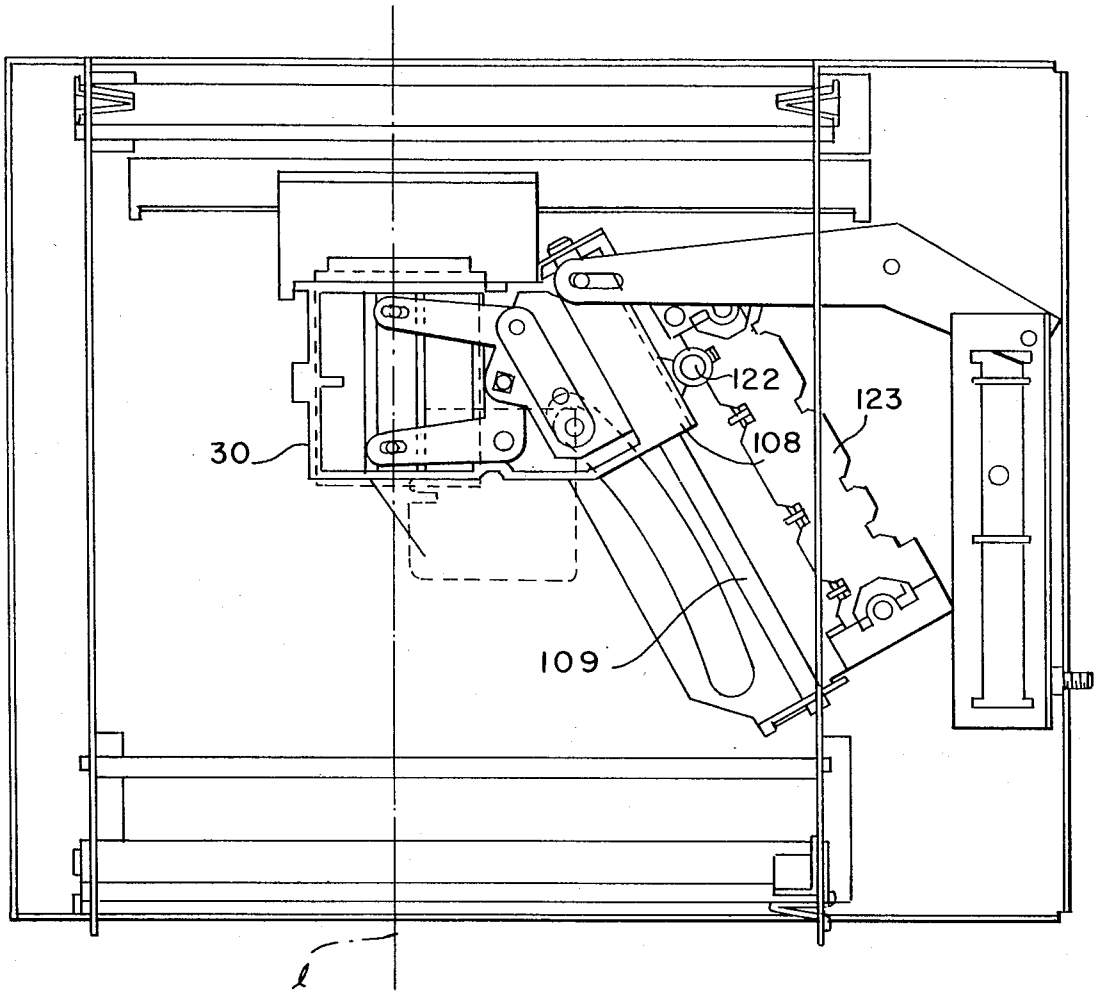

In FIG. 5(B), the lens displacement restricting pin 122 engages with the uppermost recess formed on the lens position restricting plate 123 with the upward movement of the lens holder 108 along the sliding shaft 109. The movement of the lens holder 108 from the position shown in FIG. 5(A) to the position shown in FIG. 5(B) causes the lens assembly 30 to move to an upper right position. The lens assembly 30 moves parallel to the sliding shaft 109, i.e., the lens assembly 30 moves with a certain angle formed with respect to the optical axis l. This is because an original document is placed on one side of the original document platform. In detail, when the original document is placed in this manner, the center line of the original document shifts depending on the size thereof. For example, the center line of an original document in size B5 shifts from that of an original document in size A4, i.e., the position of the optical axis l is altered depending on the size of an original document.

The detection switches 124 disposed in the respective recesses 127 serve as a means for detecting whether or not the lens displacement restricting pin 122 has engaged with a predetermined recess. If the detection switch 124 is not turned on, the indicator 75 mounted on the control panel 5 makes an error indication, which will be described later. The detection switch 124 enables an operator to check whether or not the lens assembly 30 is placed at the position which corresponds to the magnification set by the magnification converting lever 78.

Operation of lens unit displacement mechanism

When the lens displacing lever 100 moves from the position shown in FIG. 5(A) to the direction A shown by the arrow, the magnification converting lever 78 is below the position of the magnification of ×1.24. When the magnification converting lever 78 is shifted from the position below the magnification of ×1.24 to the left on the control panel, the lens displacing lever 100 moves in the direction A shown by the arrow. With the movement of the lens displacement lever 100 in the direction A, the sliding lever 101 moves in the direction A shown by the arrow. At this moment, the magnification change-over arm 104 rotates clockwise about the pin 105. This causes the lens holder 108 to move in the direction D shown by th arrow along the sliding shaft 109, which in turn, causes the lens assembly 30 to move in the direction D shown by the arrow. At this point, the member 112 is guided along the guide groove 111 and the arm 113 rotates clockwise to a small extent on the whole. This causes the first lens displacing member 114 to rotate clockwise to a small extent about the pin 115. The torque generated by this rotation is transmitted to the second lens displacing member 116 through the pin 117, which in turn causes the second lens moving member 116 to rotate to a small extent about the pin 125, with the result that the pins 120 and 121 move in the direction B and A to a small degree, respectively and that the lenses of the lens assembly 30 in which the pins 120 and 121 are mounted move inside the lens assembly 30 in the directions B and A, respectively. The moments of the lenses in the lens assembly 30 adjust the focal lengths thereof.

According to the above-described operation, the lens assembly 30 moves to a predetermined position. The magnification converting lever 78 clicks when it is shifted to the position of ×0.7. This is because the lens displacement restricting pin 122 is pressed toward the lens position restricting plate 123 by the leaf spring 126. When the operator is operating the magnification converting lever 78 in the left direction, the lever 78 clicks at the position of ×1 and ×0.8. The lens assembly 30 can be displaced at the position by handing off the lever 78 at a desired magnification position, i.e., the position where the magnification converting lever clicks. At this point, since the lens displacement restricting pin 122 engages a recess corresponding to a magnification set by the operator, the detection switch 124 mounted in the recess is turned on. If the switch 124 is not turned on, it indicates that the lens assembly 30 is not placed at a predetermined position; in which case the control unit makes an error indication by means of the indicator 75, whereby the operator finds that the magnification converting lever 78 is not placed at an appropriate position.

Construction of lens position restricting plate

In the lens unit displacing mechanism as described so far, the recesses with which the lens displacement restricting pin 122 engages are formed at the right and left sides of the lens position restricting plate 123. The recesses formed at the left side correspond to paper sheets in AB or centimeter system such as size A4, B5 and the like. The recesses formed at the right side correspond to paper sheets in inch system. When the copying machine 1 is required to copy the image of original documents in centimeter system, the lens position restricting plate 123 is mounted on the copying machine 1 so that the lens displacement restricting pin 122 is fitted in the recesses corresponding to original documents in centimeter system. When the copying machine 1 is required to copy the image of original documents in inch system, the lens position restricting plate 123 is mounted on the copying machine 1 so that the lens displacement restricting pin 122 is fitted in the recesses corresponding to original documents in inch system. As such, no other members are necessary to be replaced. Therefore, the copying machine in such a construction is not likely to give rise to parts troubles. The switch 124 is mounted on the underside of the lens position restricting plate 123. When the copying machine 1 copies original documents in inch system, the respective switches 124 are necessary to be mounted on recesses corresponding to sheets in inch system.

Driving units such as a motor are not used in the lens unit displacement mechanism according to this embodiment. The lens assembly 30 is associated with the magnification converting lever 78 to be operated by an operator. The position of the lens assembly 30 can always be set predeterminedly by the lens position restricting plate 123 and the lens displacement restricting pin 122. Therefore, the copying machine can be manufactured at a low cost because a motor as well as a sensor, and a control member to control the position of the lens are not necessary to be equipped with the copying machine. Further, the copying machine is compact because a motor is not provided therewith.

5. Blank lamp unit

Figures 6A, 6B:
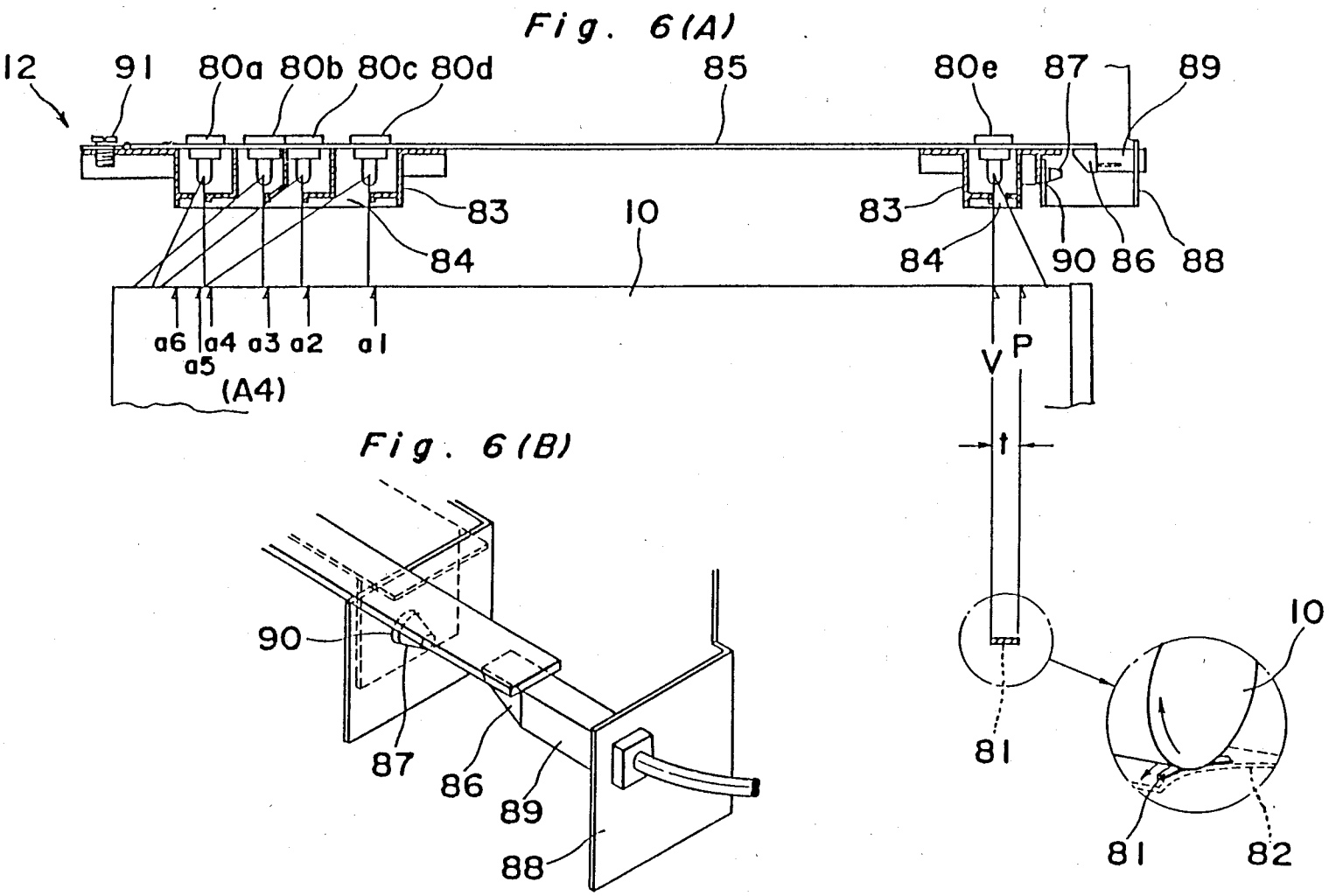
FIGS. 6(A) and 6(B) are a side sectional view and a fragmentary perspective view of a blank lamp unit employed in the copying machine of FIG. 1.

FIGS. 6(A) and 6(B) show the construction of the blank lamp unit. As shown in FIG. 2, the blank lamp unit 12 mounted on the lens unit 20 is positioned between the main charger 11 (charging unit) which uniformly charges the surface of the photosensitive drum 10 and the developing unit 13, and is disposed in the axial direction of the photosensitive drum 10. The blank lamp unit 12 is provided with five blank lamps 80*a*–80*e* which are independently turned on or off. Each of the blank lamps removes surplus electric charge which remains on the surface of the photosensitive drum 10. The blank lamps 80*a*–80*e* disposed at the left side in FIG. 6(A) remove surplus electric charge depending on the dimension of an image formed on the surface of the photosensitive drum 10. The blank lamp 80*e* disposed at the right side removes surplus electric charge which exists at the reference position of an image. The position shown by P in FIG. 2 indicates the reference position (edge of sheet) of an image. The position shown by V in FIG. 6(A) indicates an edge of a separation belt 81 disposed at the interval t between P and V. The separation belt 81 separates a paper sheet, to which a toner image has been transferred, from the photosensitive drum 10. As shown in FIG. 6(A), the separation belt 81 confronts an end of the lower portion of the photosensitive drum 10. A paper sheet 82 is placed on the separation belt 81 when the belt 81 is in the image transfer position. The separation belt 81 is interposed between the paper sheet and the photosensitive drum 10 at an end of the paper sheet 82, whereby the paper sheet to which an image has been transferred is forcibly and reliably separated from the surface of the photosensitive drum 10. The separation belt in such a construction is known in the art.

The blank lamp 80*e* disposed at the right side of the blank lamp unit 12 removes electric charge in the region right from V, namely, an end of an image, whereby toner particles are prevented from adhering to the portion of the photosensitive drum 10 with which the separation belt 81 contacts, that is, toner particles do not adhere to the separation belt 81. Accordingly, the edges of the paper sheet 82 are prevented from being smudged by toner particles.

The blank lamp unit 12 is provided with a lamp box 83 in a predetermined configuration in order to restrict a region from which electric charge is removed by the respective blank lamps.

The lamp box 83 forms chambers which partition each of the blank lamps 80*a*–80*e*. The lamp box 83 is provided with openings 84 at the portion which confronts the photosensitive drum 10 so that the openings 84 allow lights irradiated from the lamps to pass therethrough. The dimensions of the openings 84 provided with the chambers, respectively are so set that the openings 84 restrict the range of the light irradiated from each of the lamps. For example, as shown in FIG. 6(A), the dimensions of the openings 84 provided within the chamber which houses the blank lamp 80*d* is so set that the range of the light to be irradiated from the lamp 80*d* is within the hatched region, namely, from a1 to a5 of the photosensitive drum 10. Likewise, the opening 84 of the chamber which houses the blank lamp 80*c* is so dimensioned that the light to be irradiated from the blank lamp 80*c* is in the region from a2 to a6. The opening 84 of the chamber which houses the blank lamp 80*b* is so dimensioned that the light to be irradiated from the blank lamp 80*b* is in the region from a3 to the location in the vicinity of the left end of the photosensitive drum 10. The dimension of the opening 84 of the chamber which houses the blank lamp 80*a* disposed at the left end of the blank lamp unit 12 is so set that the light to be irradiated from the lamp 80*a* is in the region from a5 to the location in the vicinity of the left end of the photosensitive drum 10.

The positions a1 to a6 indicate the left end portion of an image depending on the size of an original document and a magnification set by an operator. Accordingly, when the position of the left end of an image to be formed is at a1, all of the blank lamps 80*a*–80*d* are turned on and the electric charge in the region from the position a1 to the left end of the photosensitive drum 10 is all removed. When the position of the left end of an image to be formed is at the position a3, the blank lamps 80*a* and 80*b* are turned on and the blank lamps 80*c* and 80*d* are turned off. The position shown by a5 corresponds to the left end position of an image to be formed on a paper sheet in size A4.

The dimension of the opening 84 of the lamp box 83 which houses the blank lamp 80*e* is so set that the electric charge, which exists on the photosensitive region where the separation belt 81 confronts, is removed. Specifically, the dimension of the opening 84 is set so that the left end of a light irradiated from the blank lamp 80*e* corresponds to the left end V of the separation belt 81 as shown in FIG. 6(A) and that the region from the position V to the end of the photosensitive drum 10 is irradiated.

The blank lamps 80*a*–80*e* and the lamp box 83 are mounted on a blank lamp supporting plate 85 mounted on a frame so that the plate 85 is parallel to the axis of the photosensitive drum 10. A connector 86 to supply power source with the blank lamps is mounted on the right end of the blank lamp supporting plate 85. One end of an engaging projection for placing the blank lamp unit in position 87 (hereinafter referred to as engaging projection 87) which projects toward the right is mounted on the left side of the connector 86. Mounted on a frame 88 are a connector 89 connected to the connector 86 and an engaging opening 90 with which the engaging projection 87 engages. The end of the blank lamp unit 12 is placed in position by fitting the engaging projection 87 in the engaging opening 90. When this fit-in operation is carried out, the connector 86 is connected to the connector 89, for the copying machine 1, which supplies power source to the blank lamps.

FIG. 6(B) shows an external appearance of the engaging projection 87 and the members situated in the vicinity of the fit-in opening 90 in which the engaging projection 87 is fitted.

The end of the blank lamp supporting plate 85 is fixed to the frame as described above. Therefore, the other end of the blank lamp supporting plate 85 is fixed to the frame by a screw 91.

If a small amount of a toner adheres to the separation belt 81, the toner image is developed on a paper sheet. Therefore, the opening of the lamp box 83 to restrict the range of the light to be irradiated from the blank lamp 80*e* is required to be accurately placed in position. The blank lamp unit 12 is placed in position so that the left end of the light, irradiated from the blank lamp 80*e* which passes through the opening 84, coincides with the position V of the photosensitive drum 10. If the right end of the blank lamp unit 12 is fixed to the plate 85 after the left end of the blank lamp unit 12 is placed in position, the position of the opening 84 from which a light is irradiated from the blank lamp 80*e* is not appropriately placed in position because the distance between the left end of the blank lamp unit 12 and the position V is long. According to this embodiment, since the right end of the blank lamp unit 12 is mounted on the blank lamp supporting plate 85 before the left end thereof is mounted on the unit 12, the opening 84, from which a light source is irradiated from the blank lamp 80*e*, is placed in position.

According to this embodiment, the placing of the blank lamp unit 12 in position is carried out by fitting the engaging projection 87 mounted on the portion which confronts the separation belt 81 in the fit-in opening 90 of the frame 88, and then, the other end of the blank lamp unit 12 is fixed to the plate 85 by a screw. Accordingly, the opening 84 from which a light is irradiated from the blank lamp 80*e* is correctly placed in position.

In this embodiment, the engaging projection 87 is mounted on the position where the blank lamp unit 12 is mounted and the fit-in opening 90 is mounted on the frame. However, this operation is also performed as well by reversing the positions of the two members.

6. Construction for cleaning optical system

Figure 7:
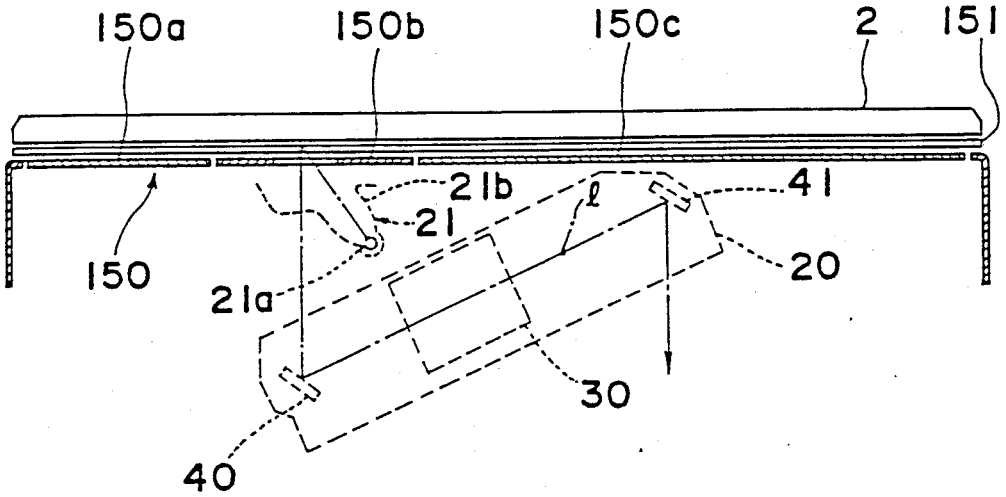
FIG. 7 is a fragmentary side sectional view showing construction of an upper plate of the copying machine of FIG. 1.
Figure 8:
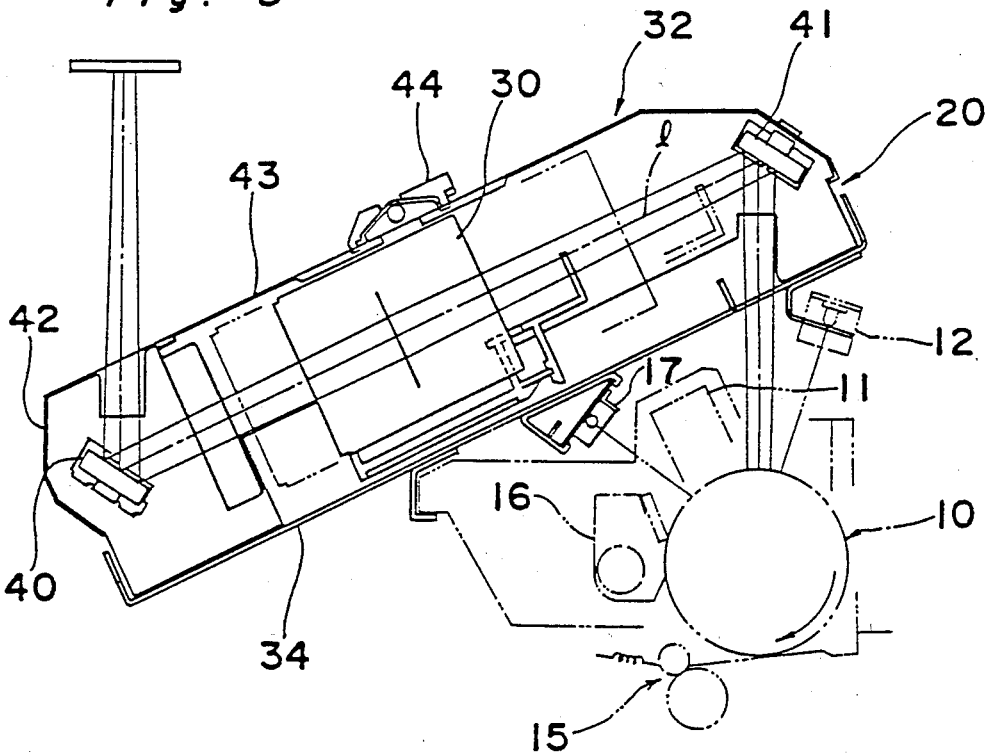
FIG. 8 is a schematic side sectional view showing construction of the lens unit.

FIGS. 7 through 9 show the construction for cleaning the optical system according to this embodiment.

In an electrophotographic copying machine according to this embodiment, the portion which confronts the light source unit mounted on the upper plate of the electrophotographic copying machine is detachably mounted. Further, the lens unit which confronts the above-described portion is also detachably mounted.

FIG. 7 is a view showing the construction of the upper plate of the copying machine according to this embodiment. The upper plate 150 of the copying machine comprises three plates 150*a*, 150*b*, and 150*c* capable of being detached. These plates are mounted by screws and are easily detached by removing the screws. The plate 150 of the copying machine is detached therefrom by opening an original document cover 2 and detaching the original document platform independently.

Of the covers 150*a* to 150*c* composing the upper plate 150 of the copying machine, the cover 150*b* disposed in the middle of the three covers is positioned directly above the light source unit 21. The left upper portion of the lens unit 20 confronts the cover 150*b*. As described later, covers capable of being opened and closed are provided on the left and right upper portions of the lens unit 20.

According to the above-described construction, by detaching each of the original document placing plates after opening the original document cover 2, and detaching the cover 150*b* positioned in the middle of the three plates 150, a reflector 21*b* and the light source 21*a* can be easily cleaned because the light source unit 21 is disposed directly below the cover 150*b*. Further, the light source unit may be detached.

FIG. 8 shows the construction of the lens unit.

The lens unit 20 includes, as described above, the lens assembly 30 and two reflecting mirrors, 40, 41 housed in the lens unit main body 32. The lens unit main body 32 comprises a side plate 35, a lens unit cover 43 covering the upper portion of the side plate 35, and the lens unit base 34 disposed at the bottom of the side plate 35.

Formed on the side plate 42 is a hook 44 which hooks the lens unit cover 43, whose detailed construction is described later.

Figure 9A:
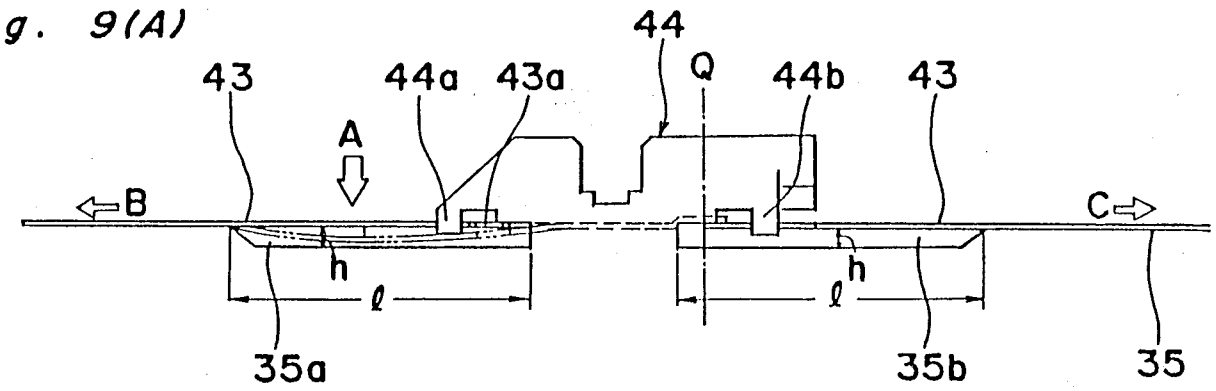
FIGS. 9(A) and 9(B) are fragmentary side elevational view and top plan view at essential portions of the lens unit for explaining construction of the lens unit cover open/close mechanism.
Figure 9B:
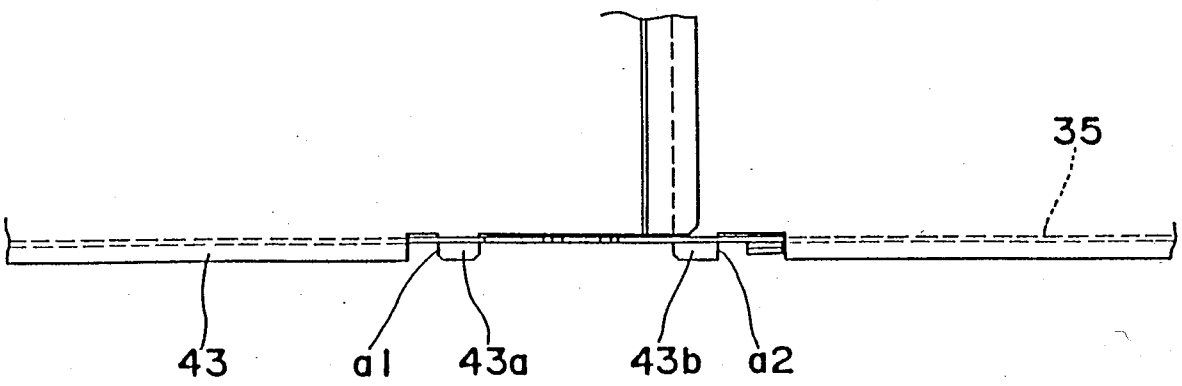

FIGS. 9(A) and 9(B) show the opening and closing mechanism of the lens unit cover 43. FIG. 9(A) is a front view of principal portions of the lens unit cover 43. FIG. 9(B) is a plan view of principal portions of the lens unit cover 43.

Hooking projections 44*a* and 44*b* are formed at the front and rear of the hook 44 which projects upward from the side plate of the lens unit main body 32. As shown in FIG. 9(B), the lens unit cover 43 has projections 43*a* and 43*b* projecting upwards from the drawing and in the axial direction of the photosensitive drum 10. The hooking projection 44*a* engages the left end a1 of the projection 43*a* of the lens unit cover 43. The hooking projection 44*b* engages the right end a2 of the projection of 43*b* disposed at the right of the lens unit cover 43. The lens unit cover 43 comprises two portions, namely, the left and right portions. The ends of the left and right portions overlap with each other at the point Q. Cut-outs 35*a* and 35*b* are formed at both sides of the hook 44. The lengths of the cut-outs 35*a* and 35*b* are much longer than that of the hooking projections 44*a* and 44*b*. The height h thereof is so set that the lowermost portions of the hooking projections 44*a* and 44*b* do not contact with those of the cut-outs 35*a* and 35*b*.

The description which is made hereinafter relates to the opening and closing operations of the lens unit cover.

In a normal condition, the hooking projections 44*a* and 44*b* of the side plate 35 engage with the ends a1 and a2 of the projections 43*a* and 43*b* formed on the lens unit cover 43. Caused by this, the lens unit cover 43 cannot be moved in the directions A and B shown by the arrow. However, the portion which confronts the cut-out 35*a* formed on the side plate 35 is bent, as shown by the two-dot chain line, by applying pressure thereto in the direction A as shown by the arrow. The projection 43*a* disengages from the hooking projection 44*a* when pressure is applied to the portion which confronts the cut-out 35*a* to such an extent that the hooking projection 44*a* is disengaged. As a result, the lens unit cover 43 disposed at the left in FIG. 9(A) is capable of moving in the direction B shown by the arrow, i.e., the force to move the lens unit cover 43 is only the force applied to the portion confronting the cut-out 35*a*. This allows the lens unit cover 43 disposed at the left of the lens unit main body 32 to be opened. In the same manner, the lens unit cover 43 disposed at the right can be opened in the direction C shown by the arrow.

As shown in FIG. 7, the light source unit 21 is disposed at the upper left of the lens unit 20. The cover 150*b* which composes the upper plate of the copying machine 1 is detachable. According to this arrangement, force may be applied downwards to the lens unit 20 in the direction A shown by the arrow in FIG. 9(A) after the cover 150*b* and the light source unit 21 are removed from the copying machine 1. In this manner, the light source unit 21 can be cleaned. Further, members mounted inside the lens unit 21 can be cleaned. The removal of the cover disposed at the left suffices to clean the lens unit cover. The lens unit cover can be cleaned perfectly by detaching the cover 150*c* disposed at the right and by opening the lens unit cover 43 in the direction C shown by the arrow illustrated in FIG. 9. In this case, the right side of the lens unit cover 43 can be favorably cleaned.

According to this embodiment, the light source unit 21 can be easily cleaned because the portion which confronts the light source unit 21 disposed on the upper plate of the copying machine 1 is detachably mounted thereon. Further, the lens unit cover 43 disposed at the left of the lens unit 20 can be opened by removing the light source unit 21. Thus, the members including the lenses mounted inside the lens unit 20 can be easily cleaned. Further, according to this embodiment, the upper plate on the copying machine 1 is detachably mounted thereon and the lens unit cover 43 disposed at the right can be opened and closed. Therefore, the members mounted in the lens unit 20 (especially the members disposed at the right side) can be cleaned very easily by removing the cover 150*c* and opening the lens unit cover disposed at the right.

7. Exhaust construction

In the electrophotographic copying machine according to this embodiment, ozone formed in the periphery of a photosensitive drum, air which contains a developer, and heat are exhausted from the copying machine by an exhaust fan through a lens unit.

Figure 10:
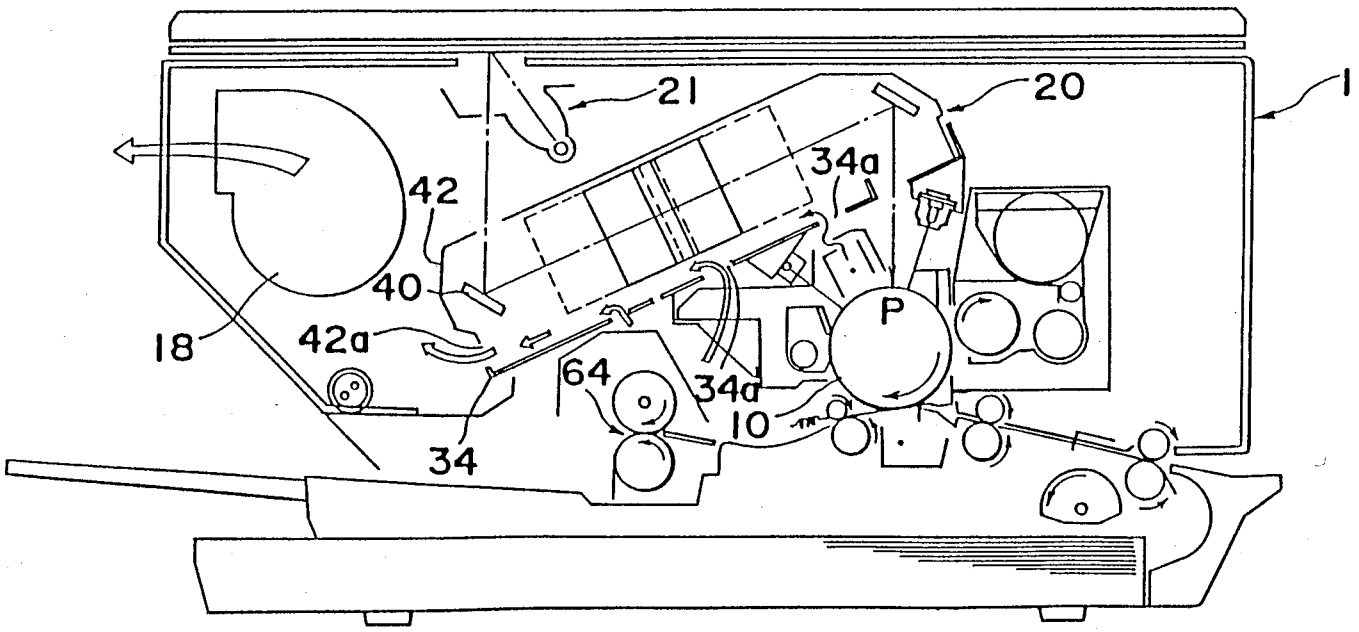
FIG. 10 is a view similar to FIG. 2 for explaining an exhaust construction of the copying machine of FIG. 1.

FIG. 10 shows how ozone formed in the periphery of the photosensitive drum 10, air containing a developer, and the heat generated from the fixing rollers 64 are exhausted from the copying machine 1.

Figure 11:
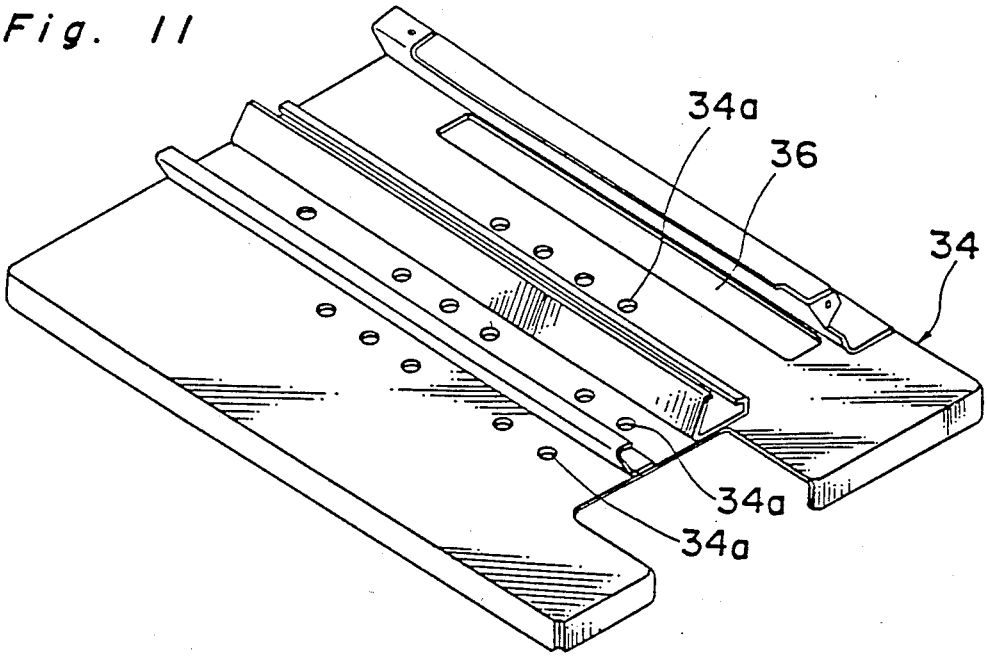
FIG. 11 is a perspective view showing a mirror unit base as observed from the bottom portion.

A plurality of suction openings 34*a* (air flow openings) are formed in the lens unit base 34 which composes the base plate of the lens unit 20. An exhaust opening 43*a* is formed at the portion positioned below the first reflecting mirror 40 provided with the side plate 35. FIG. 11 is a view taken from the underface of the mirror unit base 34. Numeral 36 denotes a slit to irradiate a light, reflected from a second reflection mirror 41, to the exposure point P illustrated in FIG. 2.

As described hereinabove, a plurality of the suction openings 34*a* are provided on the lens unit base 43 and the exhaust opening 42*a* is provided at the portion below the first reflection mirror 40 mounted on the side plate 35. Accordingly, ozone formed in the periphery of the photosensitive drum 10, ozone formed by the main charger 11, air containing a developer which has scattered in the periphery of the photosensitive drum 10, and heat generated from the fixing roller 64 is introduced from the suction opening 34*a* into the lens unit 20, and then, delivered to the exhaust opening 42*a* along the lens unit base 34, and thereafter, exhausted from the lens unit 20 through the exhaust opening 42*a*. The air thus exhausted from the lens unit 20 is exhausted from the copying machine 1 by means of the air exhaust fan 18.

Such an air exhaust construction allows the interior of the lens unit 20 to be efficiently used as an air exhaust passage. Further, air does not flow upwards, but flows along the lens unit base 34, and then, is exhausted outside from the air exhaust opening 42*a* because the air exhaust opening 42*a* which draws are into the lens unit 20 is disposed below the first reflection mirror 40. This prevents the reflection mirror 40, 41 and lens 30 from being smudged by the air which has been introduced into the lens unit 20.

8. Lens position warning display control (FIG. 12)

As described above, in the electrophotographic copying machine according to the embodiment, the position control of the lens assembly 30 is not carried out by a motor, but by the mechanism which is interlocked with the magnification converting lever 78. In order to place the lens assembly 30 at a predetermined position when the magnification converting lever 78 is operated, the lens position restricting plate 123 as well as the recesses 127 which are mounted on the edge of the lens position restricting plate 123 and which correspond to the respective magnifications are mounted on the copying machine 1. As described above, the lens assembly 30 is positioned predeterminedly when the lens displacement restricting pin 122 mounted on the lens holder 108 is fitted in the recess 127 which corresponds to a selected magnification. The problem with this mechanism is that if the magnification converting lever 78 is not correctly positioned, the lens displacement restricting pin 122 is not appropriately fitted in the recess 127 mounted on the lens position restricting plate 123. In this case, an image formation cannot be accomplished favorably.

According to the embodiment of the present invention, as described previously, the detection switches 124 are mounted on recesses 127 provided with the lens position restricting plate 123. When the lens displacement restricting pin 122 fits in the recess 127 appropriately, the switch 124 mounted on the recess 127 is turned on.

Figure 12:
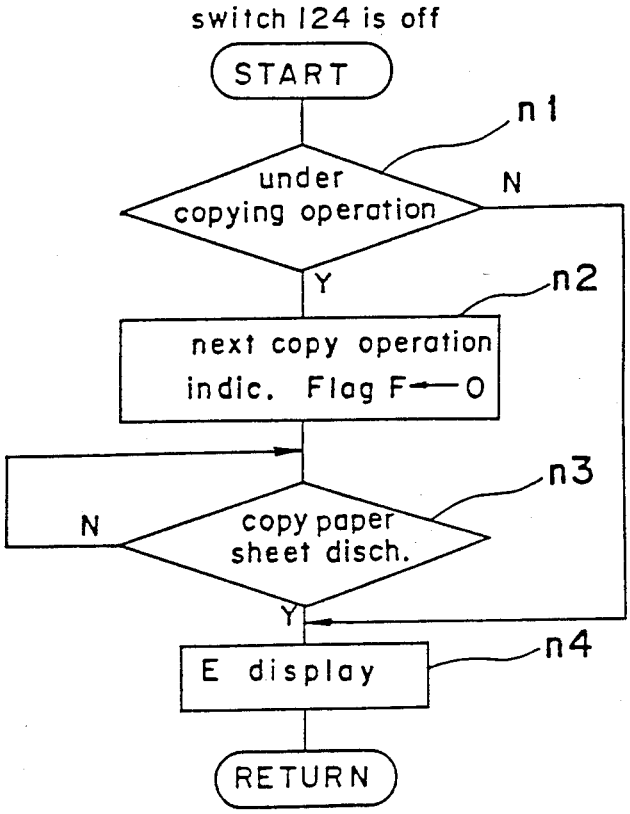
FIG. 12 is a flow-chart for explaining functioning of the control section when a lens position is not correct.

FIG. 12 is a flow chart showing how a microcomputer works when the detection switch 124 is not turned on by the operation of the magnification converting lever 78. The microcomputer is used in the control unit of the electrophotographic copying machine according to the embodiment. Signals outputted from switches and sensors are inputted in the microcomputer.

In FIG. 12, if none of the detection switches are turned on by the operation of the magnification converting lever 78, it is detected, at step n1, whether or not a copying operation is being carried out. If it is detected that a copy operation is not being made, the program advances to step n4 and an error indication (lamp E lights) is made by the indicator 75 (refer to FIG. 3). If it is detected that a copy operation is being made, the program advances from step n1 to 2n, where a flag F, which indicates the following copy operation is possible, is reset. At step n3, when a copied paper sheet is discharged from the copying machine 1, the program advances to step n4 where an error indication is made. When the error indication is made at step n4, the operator finds at this moment that the magnification converting lever 78 has not been positioned appropriately.

An operator easily finds whether or not the lens assembly 30 is positioned appropriately according to the above-described operation. Therefore, the operator can use the copying machine reliably and no erroneous copy is made.

9. Scan speed change mechanism

The image scan speed change mechanism which is one of the characteristic features of the present invention is described hereinafter.

Figure 13:
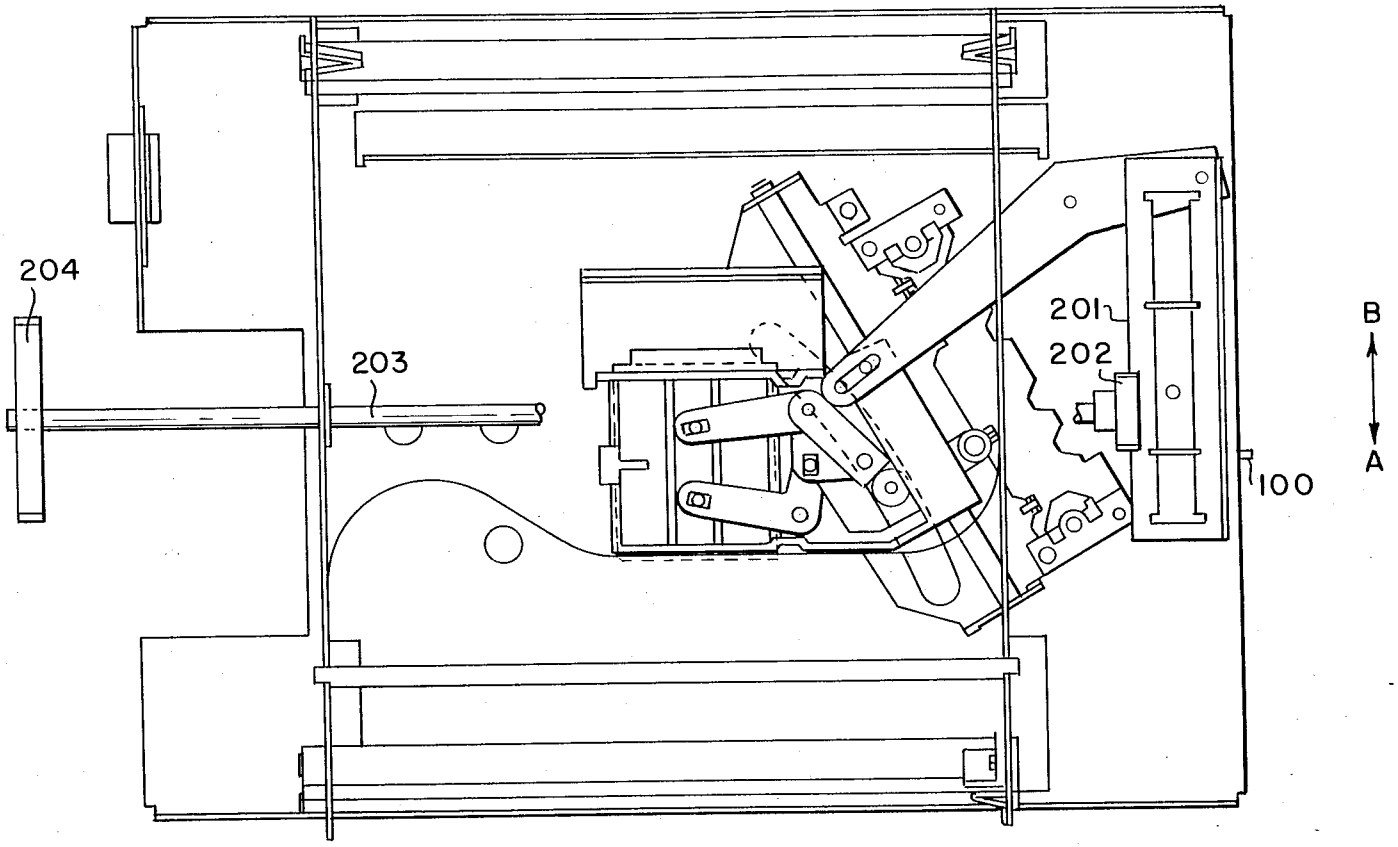
FIG. 13 is a top plan view of a lens unit displacing mechanism including magnification converting mechanism and image scan speed change mechanism in a modification of FIG. 5.

FIG. 13 is a top plane view of the lens unit displacement mechanism including a part of the scan speed change system, wherein some members in the lens unit displacement mechanism omitted in FIG. 5(A) are shown.

A rack gear 201 is mounted on the sliding lever 101. A pinion gear 202 engages with the rack gear 201. The pinion gear 202 is fixed to one end of a rotation shaft 203 which is the scan speed change shaft. A gear which rotates according to a selected variable magnification 204 (hereinafter referred to as gear 204) is fixed to the other end of the rotation shaft 203.

With the movement of the moving lever 100 in the direction A or B shown by the arrow, the rack gear 201 provided with the sliding lever 101 moves. This movement allows the pinion gear 202 to rotate, which in turn allows the rotation shafts 203 and 204 to rotate.

Figure 14:
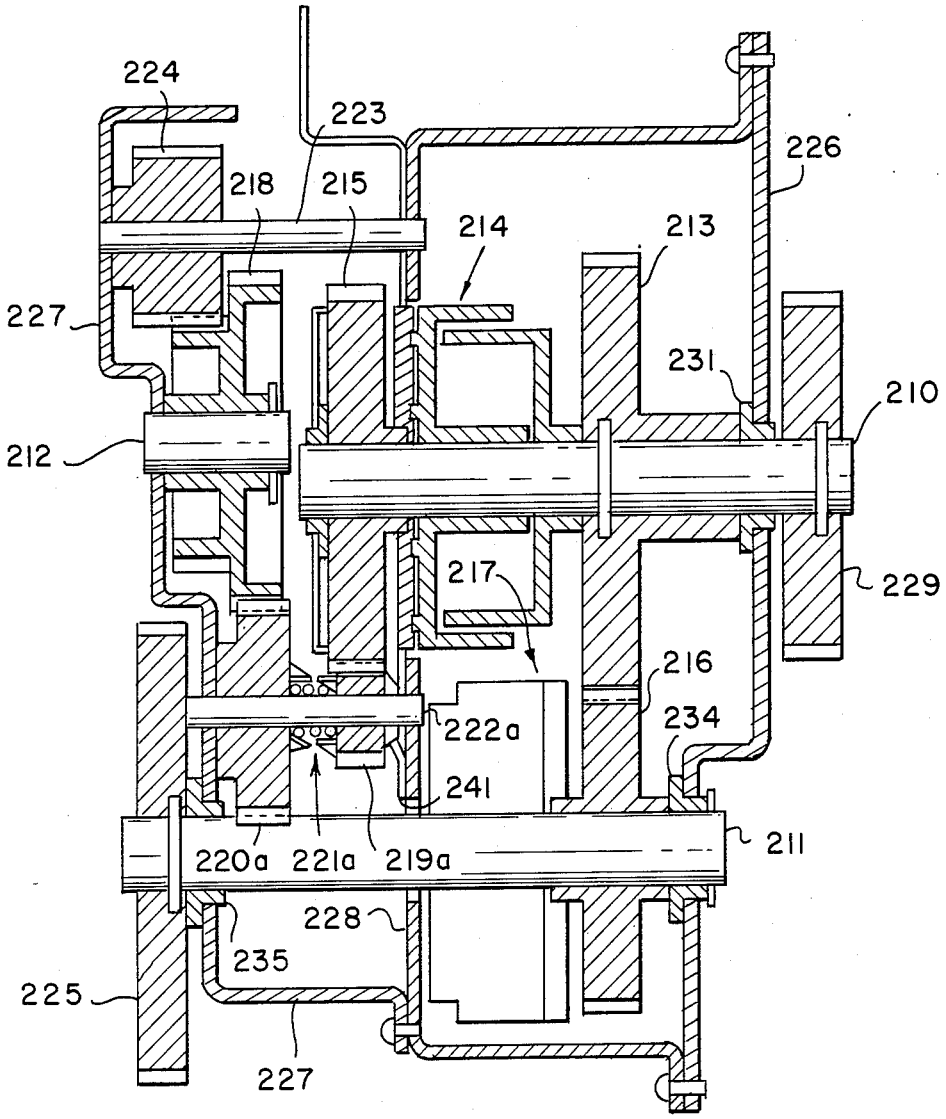
FIG. 14 is a side sectional view of the image scan speed change mechanism of FIG. 13.

FIG. 14 is a sectional view of the side portion, which shows the principal portions of the scan speed change system.

An input shaft 210 is supported by a rear frame 226 through a bearing 231. A transmission gear 229 is fixed to the end which projects from the rear frame 226. The transmission gear 229 engages with a gear not illustrated in the drawing. An unshown motor transmits driving force to the input shaft 210, which causes the transmissiono gear 229 to rotate. A connection gear 213 and one end of an electromagnetic clutch 214 are fixed to the input shaft 210. The electromagnetic clutch 214 fixes thereto a gear 215 rotatably mounted on the input shaft 210 at one end thereof. When the electromagnetic clutch 214 is driven, the gear 215 is fixed to the input shaft 210 through the electromagnetic clutch 214, so that the gear 215 rotates together with the rotation of the input shaft 210. Engaged with the gear 215 are four input shaft change gears 219*a*–219*d* mounted on shafts 222*a*–222*d*, respectively. Neither shafts 222*b*–222*d* nor input shaft change gears 219*b*–219*d* are shown in FIG. 14. Output shaft change gears 220*a*–220*d* are supported by the shafts 222*a*–222*d*, respectively. Output shaft change gears 220*b*–220*d* are not shown in FIG. 14. Rotation transmission members 221*a*–221*d* are fixed to portions where the input shaft change gears 219*a*–219*d* confront the output shaft change gears 220*a*–220*d* respectively. Rotation transmission members 221*b*–221*d* are not shown in FIG. 14. The spring mounted on the rotation transmission members 221a–221d prevent the input shaft change gears 219a–219d from contacting with the output shaft change gears 220a–220d, respectively.

The output shaft change gears 220a–220d engage with a gear 218 fixed to an output shaft 212. The gear 218 engages with a gear 224.

The connection gear 213 fixed to the input shaft 210 engages with a connection gear 216 supported by a reverse output shaft 211 mounted on the rear frame 226 through bearing 234. The reverse output shaft 211 is provided with an electromagnetic clutch 217 fixed to both a connection gear 216 and the reverse output shaft 211. When the electromagnetic clutch 217 is driven, the connection gear 216 is fixed to the reverse output shaft 211. Since the connection gear 216 rotates with the rotation of the input shaft 210. Accordingly, when the electromagnetic clutch 217 is driven, reverse output shaft 211 rotates with the connection gear 216. The reverse output shaft 211 fixes a gear 225 at one end which projects from the front frame 227. The gear 225 rotates with the reverse output shaft 211. A gear 224 which engages with a gear 218 mounted on the output shaft 223 and a gear 225 fixed to the reverse output shaft 211 engage with unshown drive gears, respectively. The unshown original document placing plate is mounted by the torque transmitted from these drive gears.

Figure 15:
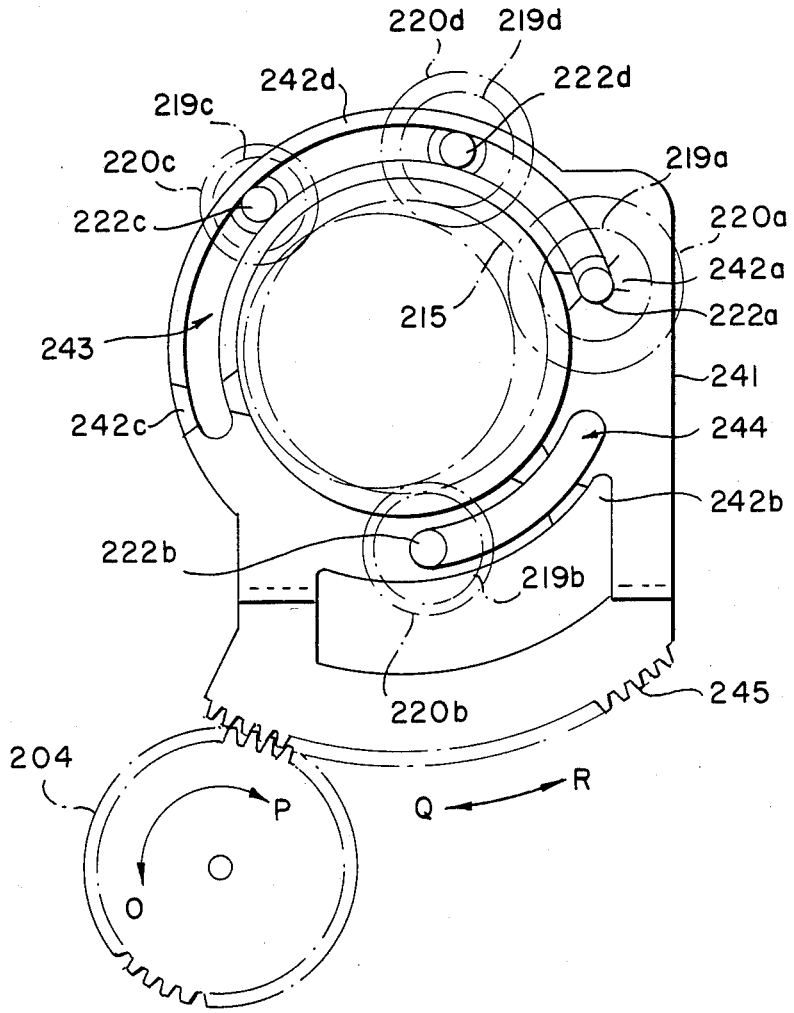
FIG. 15 is a front view of the image scan speed change mechanism of FIG. 13.

A control plate 241 which is the speed change ratio selection means according to the present invention is mounted between an inside frame 228 and the input shaft change gears 219a–219d. As shown in FIG. 15, the control plate 241 is interlocked with the shafts 222a–222b at elongated openings 243 and 244. The input shaft change gears 219a–219d supported by the shafts 222a–222d, respectively have the same number of teeth. The shafts 222a–222d are concentric with the gear 215 fixed to the input shaft 210. Therefore, the control plate 241 is rotatable about the center of the gear mounted on the input shaft 210, namely, the center of the input shaft 210.

A rack gear 245 is mounted on the control plate 241. The rack gear 245 is mounted on the circumference of the circular arc whose center is the rotation axis of the control plate 241. The rack gear 245 engages with the gear 204 fixed to the rotation shaft 203. Accordingly, when the gear 204 rotates in the direction O or P shown by the arrow in FIG. 15 caused by the movement of the moving lever 100 in the direction A or B shown by the arrow in FIG. 13, the control plate 241 rotates in the direction Q or R shown by the arrow in FIG. 15.

Projections 242a–242d are mounted on the control plate 241. Projections 242a–242d are mounted on the positions where they are capable of contacting the input shaft change gears 219a–219d, respectively. Caused by the rotation of the gears 204 in the direction O or P shown by the arrow, the control plate 241 rotates in the direction Q or R shown by the arrow, which in turn allows one of the projections 242a–242d to contact with one of the input shaft change gears 219a–219d. It is determined by the angle of rotation of the control plate 241 which of the projections 242a–242d contacts with one of the input shaft change gears 219a–219d.

Figure 16A:
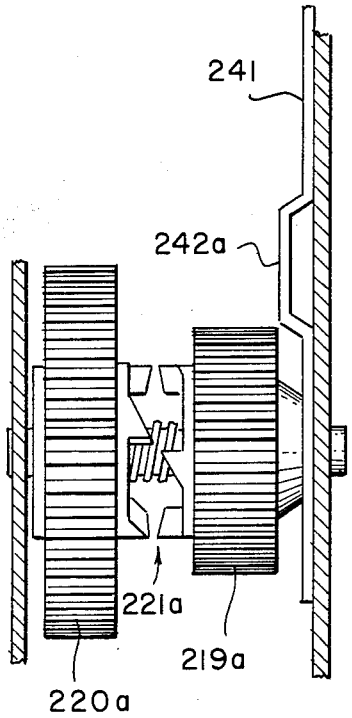
FIGS. 16(A) and 16(B) are side elevational views of a portion of the image scan speed change mechanism of FIG. 14.
Figure 16B:
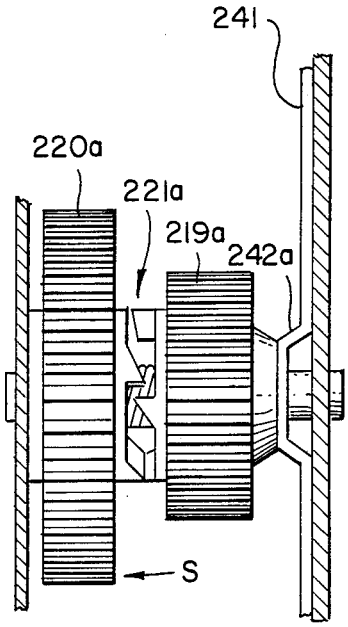

FIGS. 16(A) and 16(B) schematically show the operation of the scan speed change mechanism.

As shown in FIG. 16(A), when the projection 242a of the control panel 241 does not contact with the input shaft change gear 219a, the input shaft change gear 219a does not contact with the output shaft speed change gear 220a, owing to the elasticity of the rotation transmission member 221a. Accordingly, the torque of the output shaft speed change gear 219a is not transmitted to the output shaft change gear 220a.

As shown in FIG. 16(B), when the projection 242a contacts with the input shaft speed change gear 219a caused by the rotation of the control plate 241, the rotation transmission member 221a is pressed in the direction S shown by the arrow, with the result that the input shaft speed change gear 219a is connected to the output shaft speed change gear 220a, whereby the torque of the input shaft speed change gear 219a is transmitted to the output shaft speed change gear 220a. The above-described operation occurs in projections 242b–242d as well.

As shown in FIG. 15, the number of teeth of the output shaft speed change gears 220a–220d is different, i.e., the number of the teeth of the output speed change gears 220a–220d corresponds to the scan speed of the magnification of ×0.7, ×1 (equal magnification), ×1.24, and ×0.8, respectively. Then angle of rotation, in the direction O or P shown by the arrow, of the gear 204 corresponds to the shift length of the moving lever 100 in the direction A or B shown by the arrow. The shift length of the moving lever 100 depends on a selected copy magnification. The angle of rotation of the gear 204 is also specified by a selected copy magnification. Accordingly, the angle of rotation of the control plate 241 varies depending on a selected copy magnification. The positions of the projections 242a–242d to be mounted on the control plate 241 are determined in consideration of the above-described mechanism. For example, when a selected magnification is ×0.7, the projection 242a contacts with the input shaft change gear 219a. When a selected magnification is ×1 (equal magnification), the projection 242b contacts with the input shaft change gear 219b. When a selected magnification is ×1.24, the projection 242c contacts with the input shaft change gear 219c. When a selected magnification is ×0.8, the projection 242d contacts with the input shaft change gear 219d.

It is noted that, although in the arrangement of FIG. 15 the input shaft speed change gears 219a–219d are driven selectively in relationship with the output shaft speed change gears 220a–220d each having the different number of teeth against the other, a modification thereof will be designed to provide the output shaft speed change gears 220a–220d having the same numbers of teeth which are driven selectively in relationship with the input shaft speed change gears 219a–219d each having the different number of teeth against the other. Also, it is not necessary to arrange the input shaft speed change gears 219a–219d and the output shaft speed change gears 220a–220d on the same axial line as shown in FIG. 15. For instance, it may be construed to locate each pair of the change gears facing to each other at positions coinciding substantially in the rotational central shafts to the pair of gears with each other, or to exist an idle gear between each pair of change gears facing to, but crossing with each other to transmit the rotational force between them through the idle gear. Furthermore, it can be changed the positions of the input speed change gears 219a–219d and the output shaft speed change gears 220a–220d with each other in the arrangement of FIG. 15 to reverse the direction of the rotational force between them.

According to the above-described construction, of FIG. 15 when a certain copy magnification is selected, the force generated by the movement of the moving lever 100 is transmitted to the control plate 241 through the rack gear 201, pinion gear 206, rotation shaft 203, and gear 204. The control plate 241 rotates at the angle specified according to a selected copy magnification, and one of the projections 242*a*–242*d*, which corresponds to the selected magnification, contacts with one of the input shaft change gears 219*a*–219*d*, whereby one of the input shaft change gears 219*a*–219*d* is connected to one of the output shaft change gears 220*a*–220*d* which corresponds to the scan speed of a selected copy magnification.

When the electromagnetic clutch 214 is driven in this state, the torque generated by the rotation of the input shaft 210 is transmitted to one of the output shaft change gears 220*a*–220*d* through the gear 215 and one of the input shaft change gears 219*a*–219*d*. As a result, the original document placing plate 2 moves at the scan speed according to a selected copy magnification. When the original document placing plate 2 is returned to its original position, the electromagnetic clutch 214 is stopped from being driven and the. electromagnetic clutch 217 is driven, whereby the torque generated by the rotation of the output shaft 210 causes the reverse output shaft 211 to be driven through the connection gears 213 and 216. The torque generated by the rotation of the output shaft 211 is transmitted to the drive gear through the gear 225, whereby the original document placing plate 2 is moved in the direction opposite to the scan direction. The return of the original document placing plate 2 to its original position has no influence on copy operation members. The original document placing plate 2 moves at a fixed speed irrespective of selected magnifications.

According to the present invention, when a magnification is selected by operating a magnification converting lever, the actuation of the magnification lever is transmitted to a lens holder and a speed change ratio selection means, respectively through a magnification change-over arm and a scan speed change shaft. Therefore, a manual operation of the magnification converting lever enables the conversion of a lens position and a scan speed. By virtue of the above-described mechanism, neither a drive means for changing a lens position nor a drive means for changing a scan speed is necessary to be provided in the copying apparatus of the present invention. Therefore, the apparatus is compact and manufactured at a low cost. Furthermore, a single operation enables the conversion of a lens position and scan speed which are required to be carried out for a magnification conversion.

Also, the torque generated by the rotation of an input shaft is transmited to output shaft change gears through rotation transmission members. The apparatus is provided with a predetermined number of input shaft change gears and output shaft change gears, and the output shaft change gears have a different number of teeth. Accordingly, by selecting a rotation transmission which is operative by a speed change ratio selection member, an output shaft change gear, having teeth which corresponds to the teeth of the input shaft change gear, to be connected thereto can be selected, and as such, the rotation speed of the output shaft can be easily changed. In this operation, only the force to operate the speed change ratio selection number is sufficient to change the rotation speed of the output shaft. The load to be applied to the speed change ratio selection member is the force to operate one of the rotation transmission members. Therefore, the force to change a scan speed is very small, i.e., no particular drive force is necessary, so that the apparatus of the present invention can be operated manually and manufactured at a low cost. Further, noise generated in the above-described operation is small because a large load is not applied to the apparatus.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A magnification converting mechanism for a variable magnification copying apparatus comprising:

a magnification converting operational member provided on a control panel;

an operational torque transmitting device adapted to interlock with said magnification converting operational member;

a lens holder;

a lens assembly held by said lens holder;

an image scan speed change unit by which the image scan speed of an optical system is altered by changing speed change ratios; and a speed change ratio selection means interlocked with said operational torque transmitting device so as to make operative one of a plurality of speed change ratios provided with the image scan speed change system.

2. The image scan speed change mechanism as defined in claim 1, wherein said lens holder slidably engages with a sliding shaft and hooks part of the operational torque transmitting device, and slides on the sliding shaft with the movement of the operational torque transmitting device.

3. An image scan speed change mechanism for a variable magnification copying apparatus comprising:

a first gear fixed to a first rotational shaft;

a second gears connected drivingly to the first gears;

a fourth gear fixed to a second rotational shaft;

a third gear connected drivingly to the fourth gear;

at least said second and third gears being composed of a predetermined number of gears each having a number of teeth different from the other;

a predetermined number of rotation transmission members which transmit the torque of said second gear to said third gear confronting said second gear; and speed change ratio selection members which make one of said rotation transmission members operative.

4. The image scan speed change mechanism as defined in claim 3, wherein said first rotational shaft is an input shaft, and said second rotational shaft is an output shaft.

5. The image scan speed change mechanism as defined in claim 3, wherein said first rotational shaft is an output shaft, and said second rotational shaft is an input shaft.

6. The image scan speed change mechanism as defined in claim 3, wherein said first gear is adapted to engage directly with said second gear.

7. The image scan speed change mechanism as defined in claim 3, wherein said third gear is adapted to engage directly with said fourth gear.

8. The image scan speed change mechanism as defined in claim 3, wherein said second gear and third gear are positioned together on the same axis.

9. A magnification converting mechanism for a veriable magnification copying apparatus comprising:

a mangification converting lever provided on a control panel;

a magnification change-overe arm and an image scan speed change shaft interlocked with said magnification converting lever;

a lens holder which slidably engages with a sliding shaft and hooks part of said magnification change-over arm and slides on the sliding shaft with the movement of said magnification change-over arm;

a lens assembly held by said lens holder;

an image scan speed change unit by which the image scan speed of an optical system is altered by changing speed change ratios; and a speed change ratio selection means interlocked with the image scan speed change shaft so as to make operative one of a plurality of speed change ratios provided with the image scan speed change system.

10. An image scan speed change mechanism for a variable magnification copying apparatus comprising:

gears fixed to an input shaft;

a predetermined number of input shaft change gears which engage with said gears fixed to the input shaft;

gears fixed to an output shaft;

a predetermined number of output shaft change gears which engage with said gears fixed to the output shaft and disposed at the shaft on which said input shaft change gears are mounted and have a different number of teeth;

a predetermined number of rotation transmission members which transmit the torque of said input shaft change gears to said output shaft change gears confronting said input shaft change gears; and speed change ratio selection members which make one of said rotation transmission members operative.

* * * * *